US008491251B2

(12) United States Patent
Muraoka et al.

(10) Patent No.: US 8,491,251 B2
(45) Date of Patent: Jul. 23, 2013

(54) GRIPPING DEVICE OF WORKING MACHINE AND WORKING MACHINE WITH THE SAME

(75) Inventors: Daisuke Muraoka, Hiroshima (JP); Takanori Yamasaki, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 600 days.

(21) Appl. No.: 12/783,143

(22) Filed: May 19, 2010

(65) Prior Publication Data

US 2010/0296904 A1 Nov. 25, 2010

(30) Foreign Application Priority Data

May 20, 2009 (JP) ..... 2009-121927

(51) Int. Cl.
*B66C 1/22* (2006.01)
*B66C 1/36* (2006.01)
*B66C 3/16* (2006.01)

(52) U.S. Cl.
USPC ..... 414/739; 414/680; 414/729; 901/31; 901/37; 901/39; 294/99.1; 294/106; 294/196; 294/198

(58) Field of Classification Search
USPC 414/680, 729, 739; 901/31, 37, 39; 294/99.1, 294/106, 196, 198
See application file for complete search history.

(56) References Cited

FOREIGN PATENT DOCUMENTS

| | | |
|---|---|---|
| DE | 89 04 094 U1 | 5/1990 |
| DE | 195 06 427 C1 | 4/1996 |
| GB | 2 243 358 A | 10/1991 |
| JP | 54-168687 | 11/1979 |
| JP | 60-175634 | 9/1985 |
| JP | 2005-206291 | 8/2005 |

OTHER PUBLICATIONS

U.S. Appl. No. 12/768,005, filed Apr. 27, 2010, Daisuke Muraoka, et al.

*Primary Examiner* — Scott Lowe
(74) *Attorney, Agent, or Firm* — Oblon, Spivak, McClelland, Maier & Neustadt, L.L.P.

(57) ABSTRACT

A gripping device includes a gripping-device body mounted to an end of a working arm; two gripping members pivotably supported by this body in an opening-closing direction; and a driver that drives the gripping members to open and close them. At least one of the gripping members includes one of various kinds of detachable sections each including a gripping segment; a holding section pivotably connected to the gripping-device body about a central pivot shaft and selectively holding the detachable section in a detachable manner; and a coupling member for detachable coupling. The detachable section has a restrained segment having a detachable-section through-hole extending parallel to the central pivot shaft. The holding section has an opening-closing-direction restraining segment that restrains the restrained segment in the opening-closing direction and a holding wall to which the restrained segment is fastened with the coupling member from a direction parallel to the detachable-section through-hole.

8 Claims, 11 Drawing Sheets

GRIPPING DEVICE OF WORKING MACHINE AND WORKING MACHINE WITH THE SAME

BACKGROUND OF THE INVENTION

1. Field of the Invention

The present invention relates to a gripping device provided at an end of a working arm of a working machine, such as a hydraulic excavator, and used for gripping processing objects when dismantling a building or dismantling and separating industrial wastes, and to a working machine equipped with the same.

2. Description of the Related Art

In the related art, a known gripping device provided at an end of a working arm of a working machine includes a gripping-device body mounted to the working arm, a pair of movable gripping members that are pivotably connected to the gripping-device body so as to be openable and closable with respect to each other, and a driver that drives these gripping members so as to open and close the gripping members.

In another known example of such a gripping device, in order to allow for various kinds of gripping operations, the gripping members are each divided into a section that includes a gripping segment and a section that is to be driven by the driver while detachably holding the gripping segment.

For example, Japanese Unexamined Utility Model Registration Application Publication No. 54-168687 discloses a cutting machine, as shown in FIG. 11, which includes a cutting-machine body 101, a pair of brackets 102 pivotably supported by the cutting-machine body 101 about respective shafts 103, hydraulic cylinders 104 that actuate these brackets 102 in an opening-closing direction, and blades 105 detachably mounted to the respective brackets 102. Each bracket 102 and the corresponding blade 105 mounted thereto are respectively provided with flanges 102*a* and 105*a* that are capable coming into surface contact with each other. Moreover, the blades 105 are each provided with a boss 106 that protrudes toward the corresponding bracket 102, and the bracket 102 is provided with a hole 107 in which the boss 106 is fitted. In a state where the flanges 102*a* and 105*a* overlie each other while the bosses 106 are fitted in the corresponding holes 107, the blades 105 are detachably fastened to the corresponding brackets 102 by using bolts 108 extending through the flanges 102*a* and 105*a* in the thickness direction thereof.

In the structure shown in FIG. 11, when the left and right blades 105 grip (or cut in the case of a cutting machine) a processing object 109, a large shearing load is applied to the bosses 106 and the bolts 108 in the connection areas between the blades 105 and the brackets 102. In order to ensure strength that can bear such a shearing load, the diameters of the bosses 106 and the bolts 108 need to be increased. This inevitably leads to an increase in the size of the brackets 102 and the blades 105 and also to an increase in the amount of protrusion of the flanges 102*a* and 105*a* for extending the bolts 108 therethrough.

SUMMARY OP THE INVENTION

Accordingly, it is an object of the present invention to provide a gripping device of a working machine that allows for replacement of various kinds of gripping sections in the gripping members while ensuring high strength of the gripping members without having to significantly increase the size of the device, and to provide a working machine equipped with the same.

The present invention provides a gripping device provided at a displaceable end of a working arm of a working machine and configured to grip a processing object. The gripping device includes a gripping-device body mounted to the end of the working arm; a first gripping member and a second gripping member that are pivotably supported by the gripping-device body about respective central pivot shafts parallel to each other and are configured to open and close with respect to each other by pivoting so as to grip and release the processing object; and a driver that causes the first gripping member and the second gripping member to pivot so as to perform opening and closing operations. At least one of the first gripping member and the second gripping member includes one of various kinds of detachable sections each including a gripping segment that comes into contact with the processing object so as to grip the processing object; a holding section pivotably connected to the gripping-device body and selectively holding the detachable section in a detachable manner; and a coupling member for detachably coupling the detachable section to the holding section. An end of the detachable section opposite the gripping segment is provided with a restrained segment, the restrained segment being provided with a detachable-section through-hole extending therethrough in a direction parallel to the central pivot shafts and through which the coupling member is insertable. The holding section has an opening-closing-direction restraining segment that restrains the restrained segment from at least an outer side in an opening-closing direction and a holding wall capable of overlying the restrained segment restrained by the opening-closing-direction restraining segment from a direction parallel to the detachable-section through-hole. The holding wall is provided with a holding-section through-hole aligned with the detachable-section through-hole and through which the coupling member is insertable. The coupling member couples the restrained segment to the holding wall in a state where the coupling member is inserted through both the detachable-section through-hole and the holding-section through-hole.

The terms "detachable-section through-hole" and "holding-section through-hole" used here may be simple through-holes into which the coupling member is insertable with a certain clearance, or one of the through-holes may be a bolt hole into which a bolt serving as the coupling member can be screwed. In the former case, a nut, for example, may be screwed onto the bolt. The coupling member is not limited to a bolt and may be, for example, a coupling pin.

Furthermore, the present invention provides a working machine that includes the aforementioned gripping device; a movable working-machine body; and a working arm mounted on the working-machine body and operable such that an end thereof is displaceable relative to the working machine. The gripping device is mounted to the end of the working arm.

With the aforementioned gripping device and the aforementioned working machine equipped with the same, an appropriate detachable section selected from the various kinds of detachable sections is detachably held by the holding section of at least one of the gripping members so as to allow for various kinds of gripping operations using a single device. In addition, the holding section has the opening-closing-direction restraining segment that restrains the restrained segment, which is coupled to the holding wall thereof with the coupling member, from at least the outer side in the opening-closing direction. Therefore, the restraint on the restrained segment can prevent a large shearing load from being applied to the coupling member. Furthermore, the restrained segment and the holding wall are respectively provided with the detachable-section through-hole and the holding-section through-hole extending therethrough in the direction parallel to the central pivot shafts (in other words, extending orthogonally to the opening-closing plane of the two gripping members). Therefore, it is not necessary to provide flanges or the like for bolt insertion that protrude outward from the gripping members, as in the related art, thereby reducing stress on the coupling member, such as a bolt, with a compact structure.

Preferably, the restrained segment of the detachable section has a plate-like shape whose dimension in a thickness direction thereof that is parallel to a direction in which the detachable-section through-hole extends through the restrained segment is smaller than a dimension thereof in a direction parallel to the opening-closing direction, and the detachable-section through-hole provided in the restrained segment includes a plurality of detachable-section through-holes arranged at multiple locations on a plane orthogonal to the thickness direction.

With this device, since the restrained segment is given a greater dimension in the direction parallel to the opening-closing direction, shear strength of the restrained segment against a reaction force received from the processing object can be ensured. At the same time, the dimension of the restrained segment in the direction parallel to the detachable-section through-hole is minimized, whereby the coupling structure can be made compact. Moreover, with the plurality of detachable-section through-holes provided on the plane orthogonal to the extending direction of the detachable-section through-holes, the number of detachable-section through-holes can be increased by utilizing the area of the restrained segment while maintaining a compact structure, thereby increasing the coupling strength by the coupling member.

In the aforementioned gripping device, it is preferable that at least one of the first gripping member and the second gripping member include both of the first gripping member and the second gripping member. Moreover, the driver preferably includes a grip driving cylinder that is connected to the holding section of the first gripping member and the holding section of the second gripping member and that is configured to expand and contract so as to open and close the gripping members. Furthermore, it is preferable that the at least one of the first gripping member and the second gripping member further include an engagement member that is connected to the grip driving cylinder so as to operate in conjunction with expansion and contraction of the grip driving cylinder and that is engaged with the corresponding holding section so as to be relatively displaceable only within a predetermined range with respect to the holding section, and a spring member provided between the holding section and the engagement member. In this case, when the grip driving cylinder performs driving operation, the spring member transmits a driving force of the grip driving cylinder to the gripping-device body while maintaining a predetermined positional relationship between the engagement member and the holding section, elastically deforms due to a reaction force received from the processing object by the corresponding detachable section and the holding section holding the detachable section so as to permit displacement of the holding section relative to the engagement member, and transmits an elastic force to the corresponding gripping segment as a gripping force.

This gripping device allows for both gripping of the processing object with a large gripping force and fine adjustment of the gripping force. In detail, when the gripping segments of the gripping members first come into contact with the processing object as the two gripping members are closed in response to actuation of the grip driving cylinder, the reaction force received from the processing object causes the detachable sections and the holding sections holding the detachable sections to be relatively displaced with respect to the engagement member fixed to the grip driving cylinder as the spring member is elastically deformed. At this stage, only an elastic force equivalent to the amount of elastic deformation of the spring member is transmitted to the processing object as a gripping force, regardless of the driving force of the grip driving cylinder. Therefore, fine adjustment of the gripping force using the elastic force of the spring member is possible. Subsequently, when the relative displacement of the holding sections with respect to the engagement member reaches a limit of a permissible range, further relative displacement is not possible. Therefore, the driving force of the grip driving cylinder is directly transmitted to the processing object via the engagement member, the holding sections, and the gripping segments of the detachable sections, thereby allowing for gripping operation with a large force.

In addition, since the elastic force of the spring member and the driving force of the grip driving cylinder are both transmitted to the holding sections, gripping-force adjustability is advantageously achieved regardless of the kind of detachable sections held by the holding sections.

Furthermore, at least one of the first gripping member and the second gripping member preferably includes both of the first gripping member and the second gripping member. Moreover, it is preferable that the holding sections of the two gripping members be connected to the gripping-device body so as to be pivotable about the respective central pivot shafts, and each have a driven portion driven by the driver and a holding portion connected to the driven portion in a relatively pivotable manner only within a predetermined range about an axis parallel to the central pivot shafts and including the opening-closing-direction restraining segment and the holding wall. Preferably, each of the two gripping members further includes a spring member provided between the corresponding holding portion and an engagement member, and the spring member transmits a driving force of the driver from the driven portion to the holding portion while maintaining a predetermined positional relationship between the driven portion and the holding portion, elastically deforms due to a reaction force received from the processing object by the holding portion and the detachable section held by the holding portion so as to permit displacement of the holding portion relative to the driven portion, and transmits an elastic force to the gripping segment as a gripping force.

This gripping device similarly allows for both gripping of the processing object with a large gripping force and fine adjustment of the gripping force. In detail, when the gripping segments of the gripping members first come into contact with the processing object as the two gripping members are closed in response to actuation of the driver, the reaction force received from the processing object causes the holding portions to relatively retreat from the driven portions as the spring members are elastically deformed. At this stage, only an elastic force equivalent to the amount of elastic deformation of the spring members is applied to the processing object as a gripping force, regardless of the driving force of the driver. Therefore, fine adjustment of the gripping force using the elastic force of the spring members is possible. Subsequently, when the relative displacement of the holding portions with respect to the driven portions reaches a limit of a permissible range, further relative displacement between the driven portions and the holding portions is not possible. Therefore, the driving force of the driver is directly transmitted to the processing object via both portions and the gripping segments of the detachable sections, thereby allowing for gripping operation with a large force.

In addition, since the detachable sections are detachable from the holding portions, gripping-force adjustability is advantageously achieved regardless of the kind of detachable sections.

Alternatively or additionally, in the various kinds of detachable sections, the gripping segments of the detachable sections may include gripping segments with different degrees of elastic bendability against a reaction force received from the processing object. Thus, the gripping-force characteristics can be changed by utilizing the bendability of the gripping segment in each detachable section.

For example, the various kinds of detachable sections preferably include detachable sections with different distances from the central pivot shafts of the holding section to the gripping segments of the detachable sections in a state where the gripping segments are held by the holding section. By replacing these detachable sections to vary the pivot radii of the gripping segments thereof about the respective central pivot shafts, the bending moment acting on the detachable sections can be changed, whereby the bending characteristics of the gripping segments can be changed.

In particular, when gripping-force adjustment characteristics by the spring members in the aforementioned gripping device are to be changed, it is not exactly easy to replace the spring members to those with a different elastic modulus. However, if the gripping segments of the various kinds of detachable sections include gripping segments with different degrees of elastic bendability against a reaction force received from the processing object, the gripping-force characteristics can be changed by utilizing the bendability of the gripping segments in the detachable sections while still using the same spring members.

DESCRIPTION OF THE PREFERRED EMBODIMENTS

Preferred embodiments of the present invention will be described below with reference to the drawings.

Figure 1:
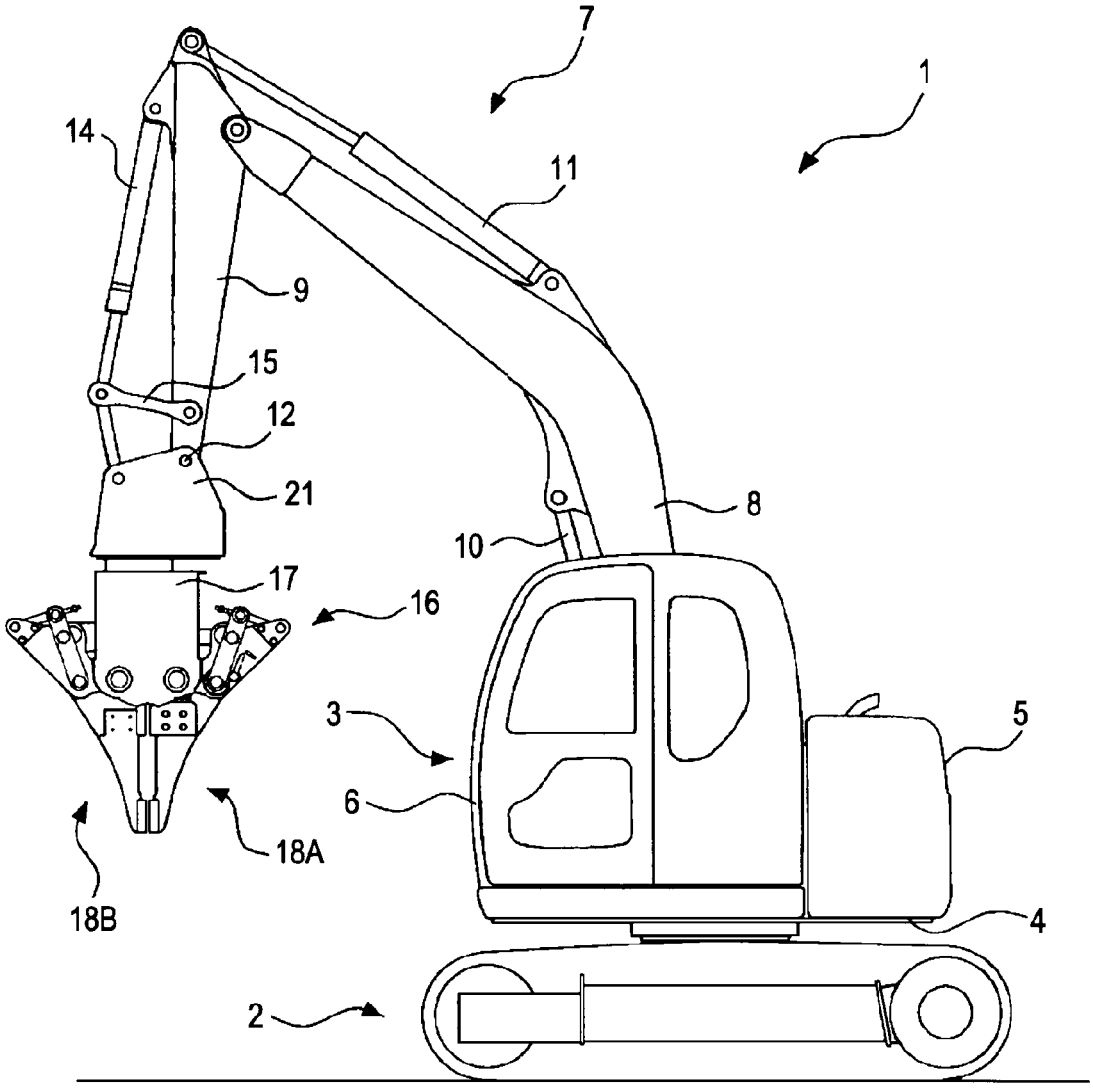
FIG. 1 illustrates a gripping device according to a first embodiment of the present invention and a working machine equipped with the same.

FIG. 1 illustrates a gripping device according to an embodiment of the present invention and a working machine equipped with the gripping device. Although FIG. 1 illustrates an example where a hydraulic excavator 1 is used as a working machine, the working machine according to the present invention is not limited to a hydraulic excavator, and the present invention is applicable to various kinds of working machines having working arms with displaceable ends.

The hydraulic excavator 1 includes a lower traveling body 2 and an upper rotatable body 3 rotatably mounted thereon. The upper rotatable body 3 has a rotating frame 4. A counterweight 5, a cabin 6, and a working arm 7 are mounted on the rotating frame 4.

The working arm 7 includes a boom 8 and an arm 9, and a boom cylinder 10 and an arm cylinder 11 for respectively driving the boom 8 and the arm 9. The boom 8 is mounted on the rotating frame 4 in a derrickable fashion (i.e., in a pivotable fashion in the left-right direction of the rotating frame 4 about an axis) and is driven in the derricking direction by expansion and contraction of the boom cylinder 10. The arm 9 is pivotably connected to a terminal end of the boom 8 and is driven in the pivoting direction by expansion and contraction of the arm cylinder 11. With combinations of the pivoting movements of the boom 8 and the arm 9 and the rotation of the rotating frame 4, the terminal end of the arm 9 is freely displaceable.

The working machine according to the present invention is not limited to a rotatable type. Furthermore, the working arm may be of a type that has a single joint or a type that has multiple joints.

Normally, a bucket (not shown) is pivotably mounted to the terminal end of the arm 9 via a bucket pin 12 and is driven in the pivoting direction by a bucket cylinder 14. In detail, an idler link 15 is pivotably mounted to the arm 9. The idler link 15 is connected to the bucket cylinder 14, and the bucket is connected to the idler link 15. The idler link 15 and the bucket (not shown) are driven by expansion and contraction of the bucket cylinder 14. In this embodiment, a gripping device 16 is detachably mounted as a working attachment in place of the bucket.

Figure 2:
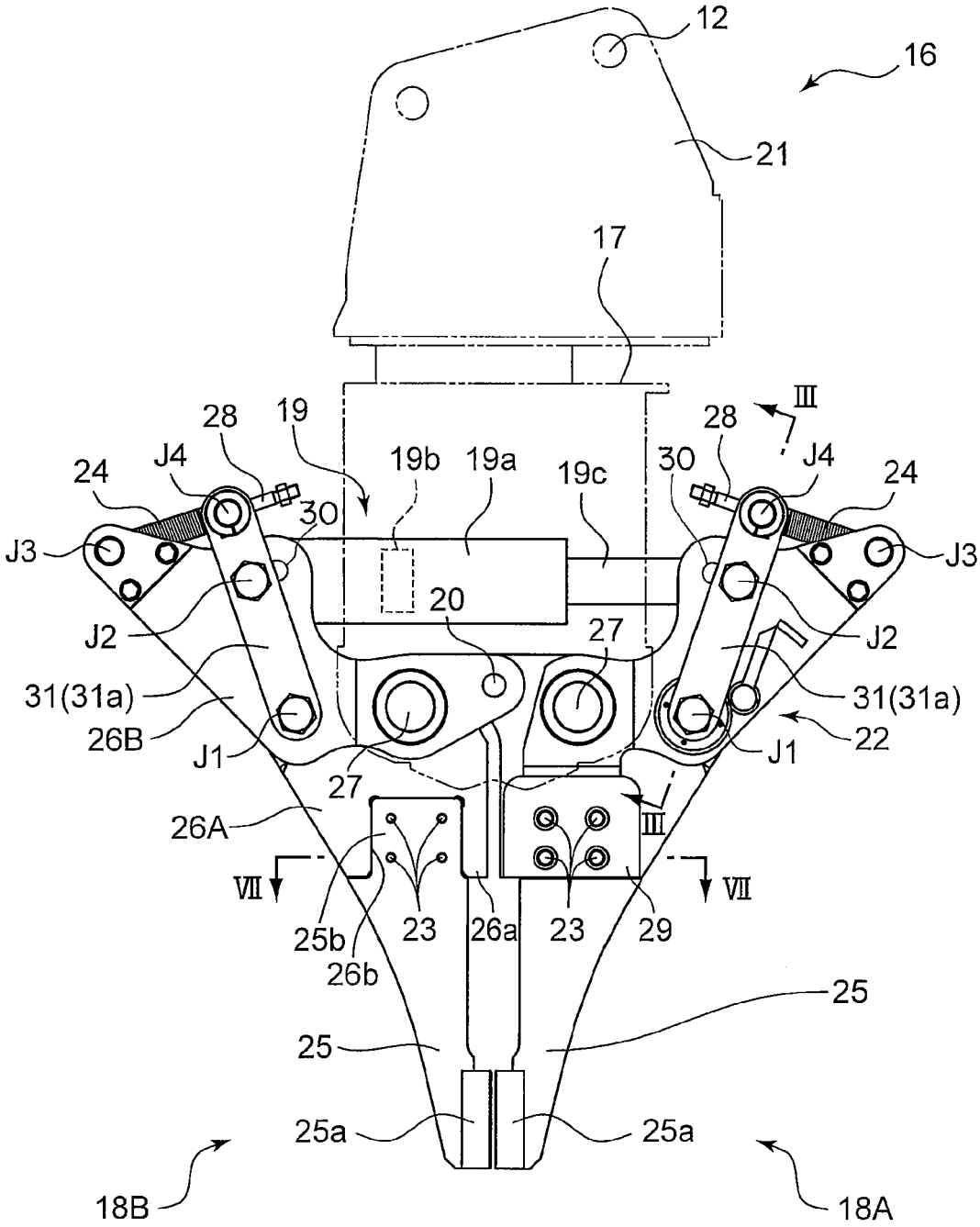
FIG. 2 is an enlarged front view of the gripping device shown in FIG. 1.

Referring to FIG. 2, the gripping device 16 includes a gripping-device body 17, a first gripping member 18A and a second gripping member 18B that form a pair, a grip driving cylinder 19 serving as a driver for driving these gripping members 18A and 18B in the opening-closing direction, and a connecting pin 20 that pivotably connects the gripping members 18A and 18B to each other. The gripping-device body 17 is connected to a mounting member 21, and this mounting member 21 is detachably connected to the arm 9 and the idler link 15.

Figure 3:
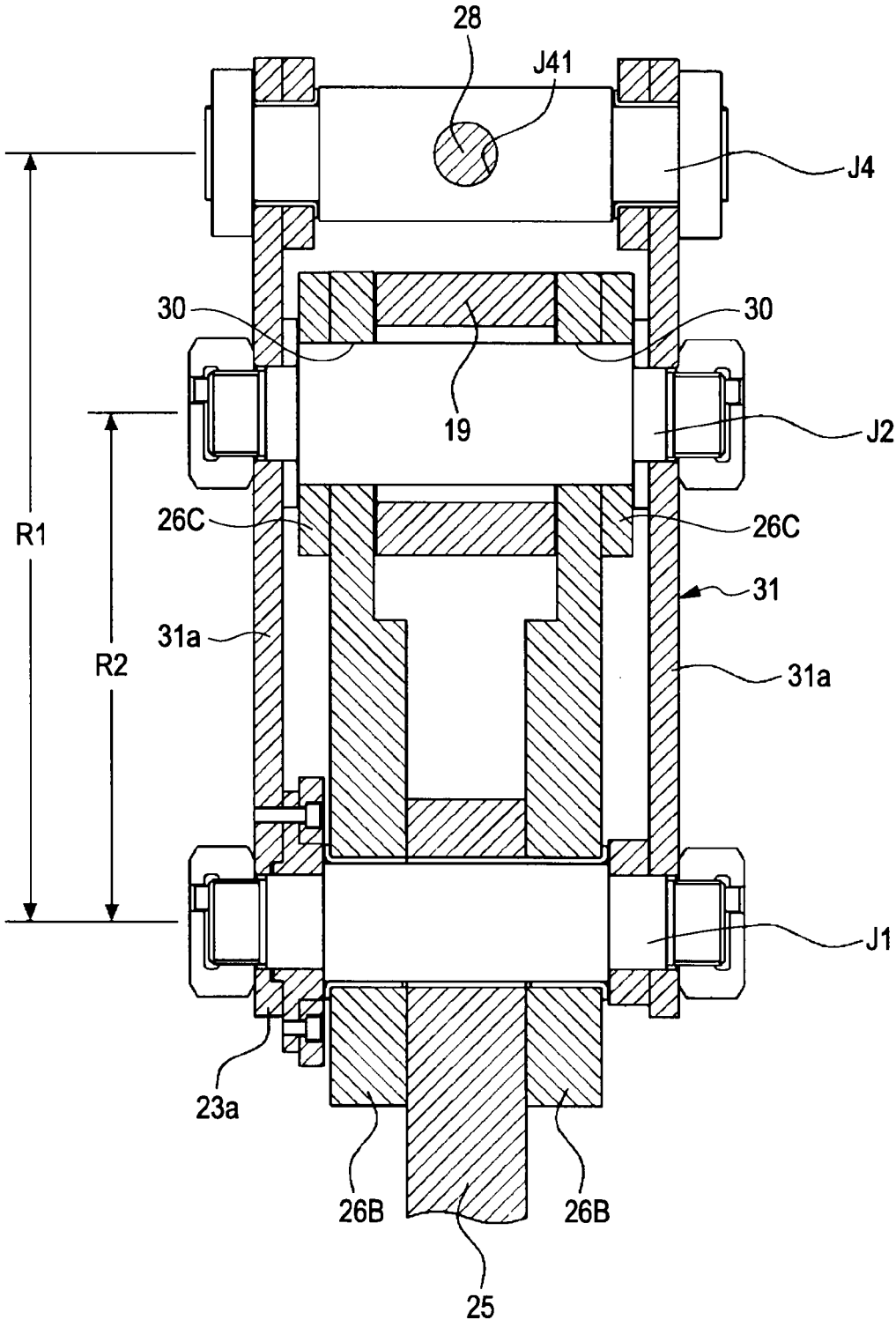
FIG. 3 is a cross-sectional view taken along line III-III in FIG. 2.
Figure 4:
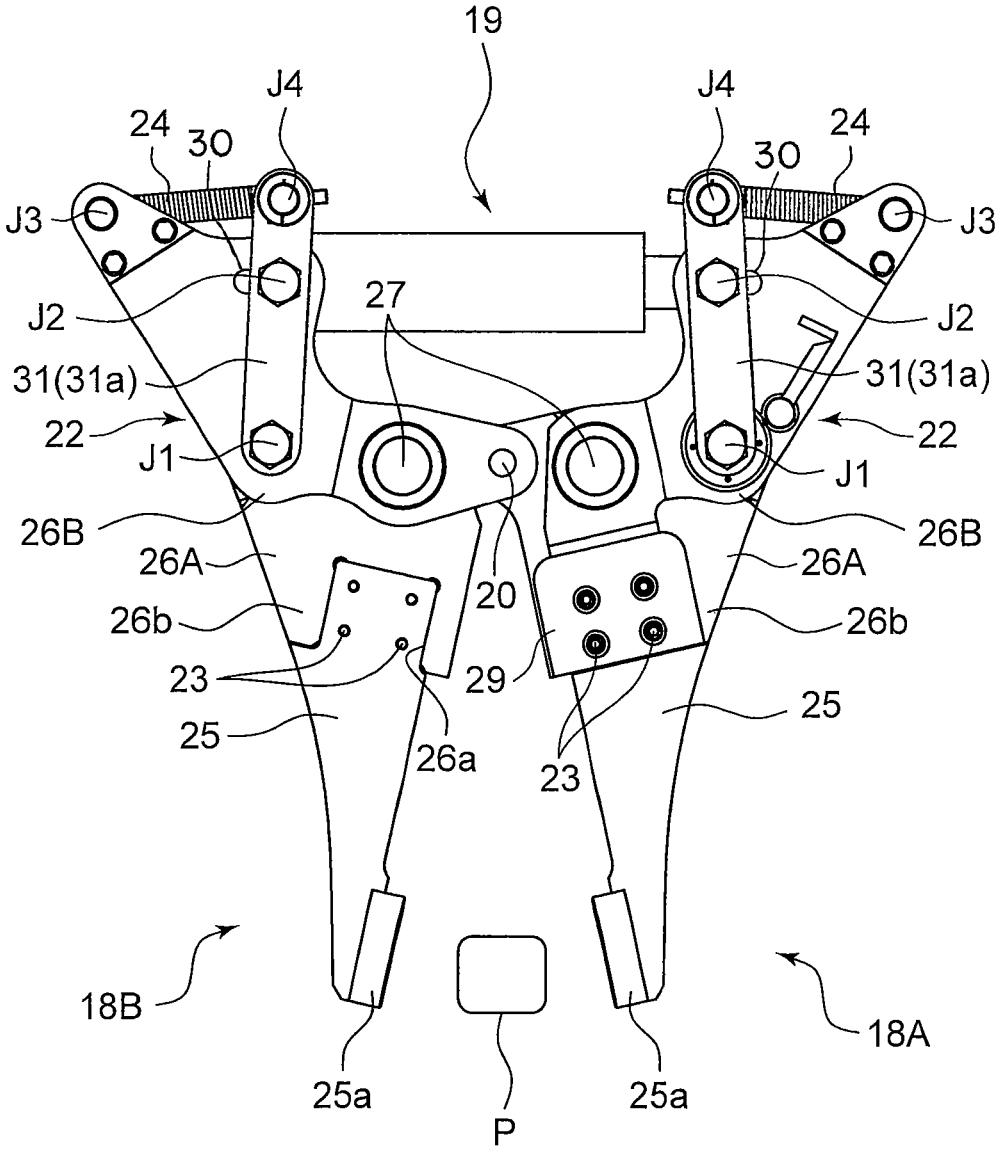
FIG. 4 is a front view for explaining gripping operation performed by the gripping device in FIG. 2, showing a state prior to the start of the gripping operation.

FIGS. 2 to 4 illustrate the gripping members 18A and 18B in detail. The gripping members 18A and 18B are for gripping, for example, a processing object P, as shown in FIG. 4, from opposite sides, and each include a detachable section 25, a holding section 22, a plurality of bolts (coupling members) 23, a link member 31, and a coil spring 24 serving as a spring member.

The detachable sections 25 have a plate-like shape and are detachably held by the corresponding holding sections 22, as well as having gripping segments 25*a* for gripping the processing object P from opposite sides in the aforementioned held state. In this embodiment, each gripping segment 25*a* is detachably mounted to a terminal end of the corresponding detachable section 25.

The holding sections 22 each have a terminal-end plate 26A for detachably holding the corresponding detachable section 25, and a pair of base-end plates 26B that sandwich the terminal-end plate 26A in the thickness direction thereof. The two base-end plates 26B are connected to the gripping-device body 17 so as to be pivotable about a central pivot shaft (a pin in this embodiment) 27 extending through the base-end plates 268 in the thickness direction thereof and parallel to the central pivot shaft 27 in the other holding section 22. The detachable section 25 and the plates 26A and 268 are both disposed such that the thickness direction thereof is oriented parallel to the central pivot shaft 27.

The detachable section 25 is mounted to the terminal-end plate 26A by using the bolts 23. A specific structure therefor will be described later.

The grip driving cylinder 19 is formed of a hydraulic cylinder. The grip driving cylinder 19 is provided between base ends of the two holding sections 22 and is connected to these base ends. The grip driving cylinder 19 has a cylinder body 19*a*, a piston 19*b* accommodated within the cylinder body 19*a*, and a rod 19*c* extending from the piston 19*b* towards one side in a cylinder-axis direction. A terminal end of this rod 19*c* is pivotably connected to the base end of the holding section 22 of the first gripping member 18A, whereas a head end of the cylinder body 19*a* is connected to the base end of the holding section 22 of the second gripping member 18B. Therefore, the two holding sections 22 are driven in the opening-closing direction by expansion and contraction of the grip driving cylinder 19.

Figure 6B:
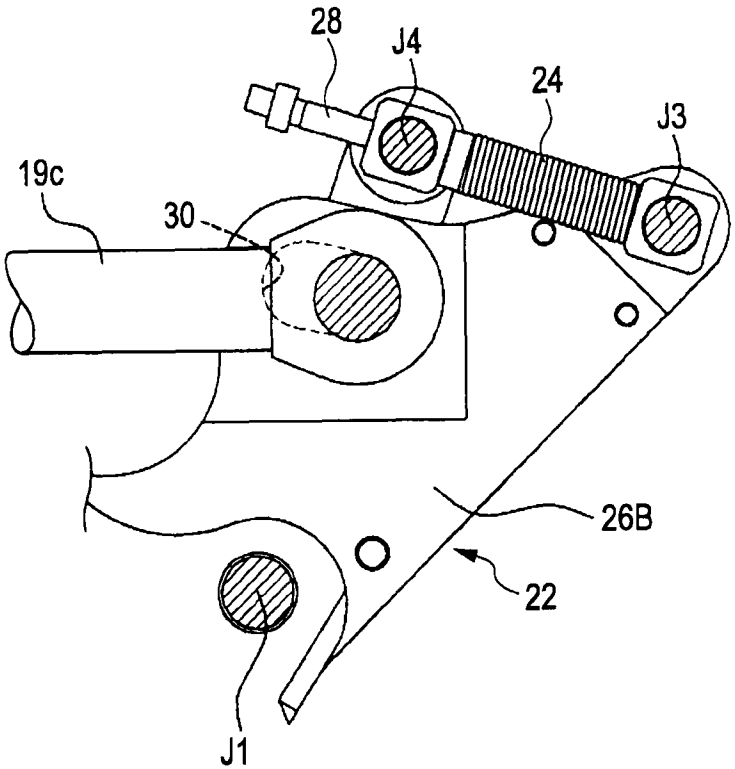
FIGS. 6A and 6B are cross-sectional views for explaining the gripping operation performed by the gripping device in FIG. 2, FIG. 6A showing a state corresponding to that in FIG. 5A and FIG. 6B showing a state corresponding to that in FIG. 5B.
Figure 6A:
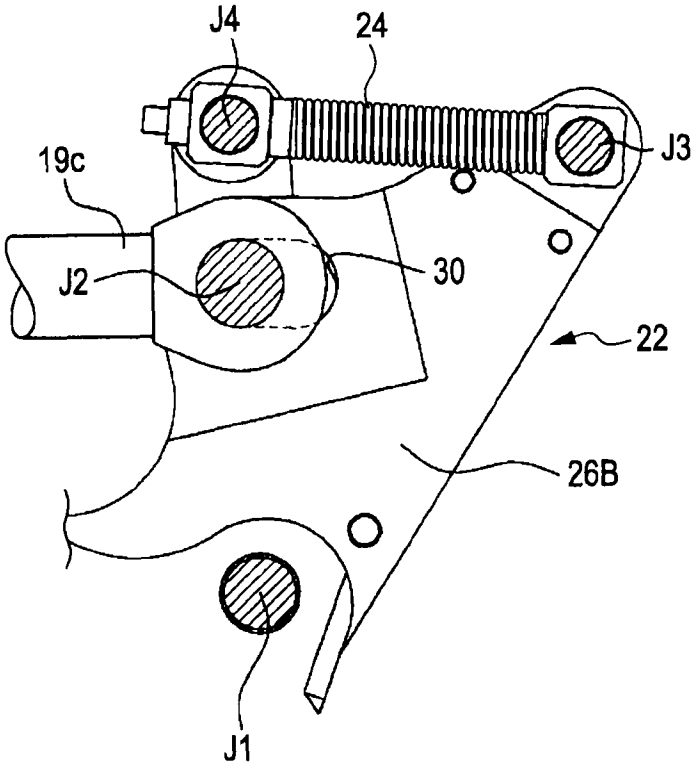

Engagement shafts (engagement members) J2 are respectively fixed to the terminal end of the rod 19*c* and the head end of the cylinder body 19*a*. The engagement shafts J2 are disposed so as to be oriented parallel to the central pivot shafts 27, and are respectively engaged to the base ends of the base-end plates 26B of the corresponding holding sections 22. Specifically, as shown in FIGS. 6A and 6B, the base-end plates 26B and reinforcement plates 26C overlying the base-end plates 26B are provided with through-holes 30. The engagement shafts J2 extend through the corresponding through-holes 30 in the axial direction thereof so as to be engaged in a slidable manner within the through-holes 30. Therefore, each engagement shaft J2 can be relatively displaced with respect to the corresponding holding section 22 only within a range in which the corresponding through-hole 30 is formed. In detail, the engagement shaft J2 is slidable within the through-hole 30 between a position where the engagement shaft J2 abuts on an inner end of the through-hole 30 (i.e., an end closer to the center of the gripping device), as shown in FIG. 6A, and a position where the engagement shaft J2 abuts on an outer end of the through-hole 30, as shown in FIG. 6B.

The link members 31 are provided for allowing the relative displacement of the engagement shafts J2 with respect to the holding sections 22 to be in conjunction with expansion and contraction of the coil springs 24, and each include a pair of lever plates 31*a* provided outside the corresponding base-end plates 26B.

Base ends of each pair of the lever plates 31*a* are connected to the corresponding base-end plates 26B such that the lever plates 31*a* are pivotable about a link pivot shaft J1 positioned below the corresponding engagement shaft J2 and parallel to the corresponding central pivot shaft 27. The engagement shaft J2 extends through intermediate parts of the lever plates 31*a* so as to be connected to the aforementioned parts.

Terminal ends of each pair of the lever plates 31*a* are provided with a spring contact shaft J4 that is parallel to the shafts J1 and J2. The spring contact shaft J4 is in contact with the corresponding coil spring 24.

The coil spring 24 is configured to apply a biasing force to the corresponding engagement shaft J2 towards the inner side of the device (i.e., towards the central shaft), and is mounted to the corresponding base-end plates 26B. In detail, the base-end plates 26B of each pair are provided with a spring pivot shaft J3 positioned outside relative to the corresponding engagement shaft J2 and extending through the base-end plates 26B in a direction parallel to the engagement shaft J2. Moreover, the base-end plates 26B are connected to a spring support shaft 28 extending orthogonally to the spring pivot shaft J3, and the spring support shaft 28 is pivotable about the spring pivot shaft J3. The coil spring 24 is provided around the spring support shaft 28 so as to be coaxial therewith.

The spring support shaft 28 extends in a direction orthogonal to the spring contact shaft J4. In detail, as shown in FIG. 3, the spring contact shaft J4 is provided with a hole J41 extending therethrough in a direction orthogonal to the axis thereof. The spring support shaft 28 is inserted through this hole J41, and the spring contact shaft J4 is slidable along this spring support shaft 28. The coil spring 24 in a compressed state is interposed between the spring contact shaft J4 and the spring pivot shaft J3.

The through-holes 30 in which the engagement shafts J2 are fitted are formed in a circular-arc shape centered on the corresponding link pivot shafts J1. Therefore, sliding operation of the engagement shafts J2 within the through-holes 30 (i.e., relative displacement between the holding sections 22 and the engagement shafts J2) is converted to pivoting operation of the link members 31, through which the engagement shafts J2 extend, about the link pivot shafts J1. In response to this pivoting operation, the coil springs 24 that are in contact with the spring contact shafts J4 extending through the link members 31 expand and contract along the spring support shafts 28. Consequently, the elastic force of the coil springs 24 acts on the holding sections 22 as a force that biases the holding sections 22 in the closing direction (gripping direction), as viewed from the engagement shafts J2.

Next, the detachable structure of each detachable section 25 with respect to the corresponding holding section 22 will be described.

In each detachable section 25, an end (base end) opposite the gripping segment 25*a* is provided with a restrained segment 25*b*. The restrained segment 25*b* has a substantially rectangular plate-like shape whose width is slightly smaller than that of a part adjacent to an end thereof and whose thickness direction is parallel to the corresponding central pivot shaft 27. A dimension D (FIG. 7) of the restrained segment 25*b* in the thickness direction is smaller than a width (L in FIG. 7) thereof in a direction parallel to the opening-closing direction.

Multiple detachable-section through-holes 25*d* extend through the restrained segment 25*b* in the thickness direction thereof. The detachable-section through-holes 25*d* are threaded holes that are arranged at various locations (four locations in the drawings) on a plane orthogonal to the thickness direction.

On the other hand, the terminal-end plate 26A constituting each holding section 22 has an inner restraining segment 26*a* that restrains the corresponding restrained segment 25*b* from the inner side in the opening-closing direction, an outer restraining segment 26*b* that restrains the restrained segment 25*b* from the outer side in the opening-closing direction, and a holding wall over which the restrained segment 25*b* fitted between these restraining segments (opening-closing direction restraining segments) 26*a* and 26*b* can lie from a direction parallel to the detachable-section through-holes 25*d*.

Figure 7:
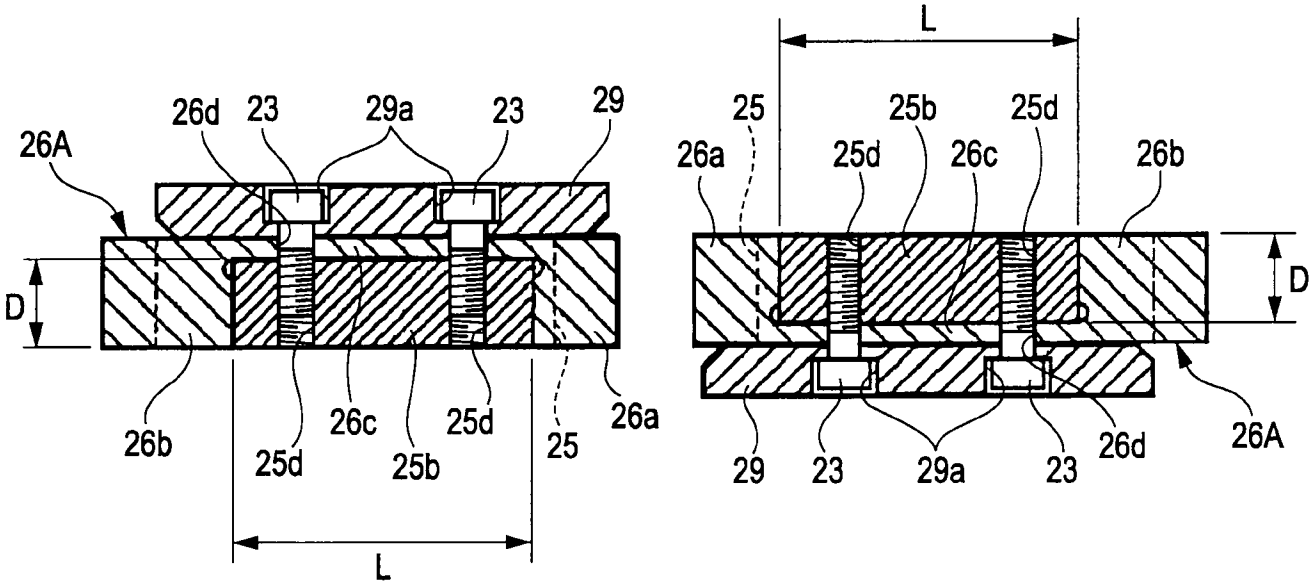
FIG. 7 is a cross-sectional view taken along line VII-VII in FIG. 2.

As shown in FIG. 7, each holding wall is constituted of a thin sidewall 26*c* remaining in the terminal-end plate 26A and a reinforcement plate 29 (for ensuring a thicker wall) bonded to the sidewall 26*c* while overlying the sidewall 26*c*. The sidewall 26*c* has bolt through-holes 26*d* extending therethrough and aligned with the corresponding detachable-section through-holes 25*d*. The reinforcement plate 29 is provided with countersunk holes 29*a* that accommodate heads of the bolts 23. The holes 26*d* and 29*a* of each pair are aligned with each other so as to constitute a holding-section through-hole. By screwing the external-thread portion of each bolt 23 inserted through the corresponding holding-section through-hole into the corresponding detachable-section through-hole 25*d*, the restrained segment 25*b* is fastened to the holding wall while overlying the holding wall.

Of the opening-closing-direction restraining segments 26*a* and 26*b*, the inner restraining segments 26*a* can be omitted, where necessary. The bolts 23 can be prevented from receiving a large shearing load during gripping operation, to be described later, so long as at least the outer restraining segments 26*b* are provided.

Objects into which the bolts 23 are screwed are not limited to the detachable-section through-holes 25*d*. For example, the holding-section through-holes may be threaded holes into which the bolts 23 can be screwed. As another alternative, both bolt holes may simply be bolt insertion holes. In that case, each restrained segment 25*b* can be fastened to the corresponding holding wall by screwing nuts onto the bolts 23 inserted through the bolt insertion holes.

Furthermore, the coupling members according to the present invention are not limited to the bolts 23. For example, the coupling members may each be constituted of a pin inserted through the corresponding through-hole 25*d* and a retaining member that is engaged with an end of the inserted pin for preventing the pin from being disengaged from the through-hole 25*d*.

Next, the operation of the gripping device 16 will be described.

In the gripping device 16, the gripping members 18A and 11*n* are driven in the opening-closing direction by expansion and contraction of the grip driving cylinder 19 so as to perform gripping operation on the processing object P. First, as shown in FIG. 4, in a state where the gripping members 18A and 18B are open, the working arm 7 is operated so that the gripping segments 25*a* of the detachable sections 25 in the gripping members 18A and 18B are positioned on the outer sides of the processing object P. In this position, when the grip driving cylinder 19 is actuated in the expanding direction, the gripping members 18A and 18B pivot in the closing direction while the coil springs 24 constantly maintain the relative position between the holding sections 22 and the engagement shafts J2 fixed to the grip driving cylinder 19. The relative position in this case is a position in which each engagement shaft J2 is in abutment with the inner end of the inner surface of the through-hole 30 in the base-end plates 26B of the corresponding holding section 22, as shown in FIG. 6A.

Figure 5B:
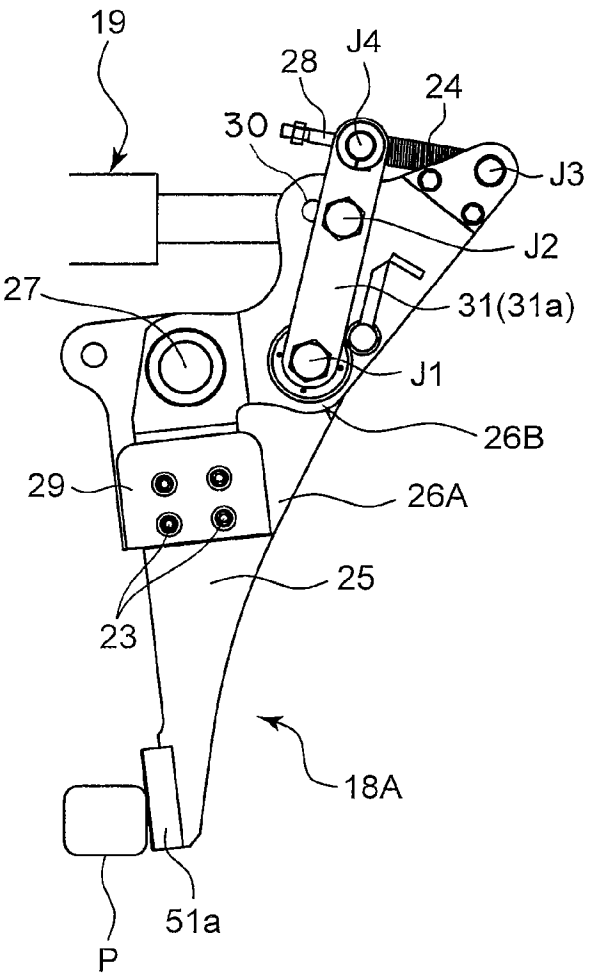
FIGS. 5A and 5E are front views for explaining the gripping operation performed by the gripping device in FIG. 2, FIG. 5A showing a state where a gripping segment is starting to come into contact with a processing object and FIG. 5B showing a retreated state with respect to an engagement member while the gripping segment maintains the contact with the processing object.
Figure 5A:
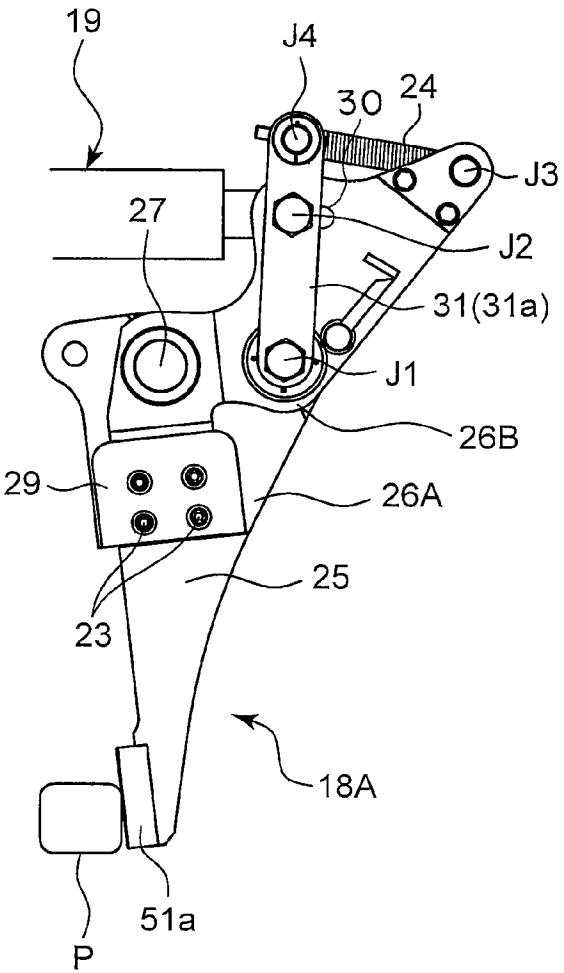

As a result of the pivoting movement in the closing direction, the gripping segments 25*a* come into contact with the processing object P, as shown in FIG. 5A. For some time after the contact, the only movement that occurs is that the engagement shafts J2 slide within the through-holes 30 as the link members 31 pivot about the link pivot shafts J1 (that is, the engagement shafts J2 are relatively displaced with respect to the holding sections 22). Therefore, although the expansion force of the grip driving cylinder 19 is not directly transmitted to the gripping members 18A and 18B, the coil springs 24 are compressed so as to permit relative displacement of the engagement shafts J2 with respect to the holding sections 22. Thus, the elastic force of the coil springs 24 increases and is transmitted as a gripping force to the gripping segments 25*a* of the detachable sections 25 via the holding sections 22. By utilizing this elastic force, the gripping force can be finely adjusted with relatively simple operation.

Subsequently, as each engagement shaft J2 continues to slide within the corresponding through-hole 30 and comes into abutment with the outer end of the inner surface of the through-hole 30, as shown in FIG. 6B, since the engagement shaft J2 cannot be further displaced relative to the corresponding holding section 22, the expansion force of the grip driving cylinder 19 applied to the engagement shaft J2 is directly transmitted to the holding section 22 and then to the gripping segment 25*a* of the corresponding detachable section 25. Therefore, from this stage, the processing object P can be gripped with a large gripping force.

On the other hand, since the detachable sections 25 are detachably held by the terminal-end plates 26A of the holding sections 22, various kinds of detachable sections 25 with different shapes, structures, and materials may be prepared and appropriately replaced so as to allow for various kinds of gripping operations with a single gripping device 16. In addition, each detachable section 25 is fastened to the corresponding holding wall (sidewall 26*c* and reinforcement plate 29) with the bolts 23 while the restrained segment 25*b* thereof is restrained in the opening-closing direction by the restraining segments 26*a* and 26*b* of the corresponding base-end plates 26B. Therefore, the restraint on the restrained segment 25*b* by the restraining segments 26*a* and 26*b* can prevent large shearing stress from being generated in the bolts 23. Furthermore, since the detachable-section through-holes 25*d* and the holding-section holes 26*d* and 29*a* into which the bolts 23 are inserted extend through the restrained segment 25*b* and the holding wall in the thickness direction thereof, the stress on the bolts 23 can be reduced by a more compact structure, as compared with the structure as in the related art in which flanges for inserting bolts therethrough protrude outward from the gripping members.

In particular, as shown in FIG. 7, if each restrained segment 25*b* has a plate-like shape and has a cross-sectional shape in which the dimension D in the thickness direction thereof (i.e., a direction parallel to the axial direction of the detachable-section through-holes 25*d*) is smaller than the dimension L in the width direction (i.e., a direction parallel to the opening-closing direction), sufficient strength against a shearing load occurring during gripping operation can be ensured while minimizing the dimension D in the thickness direction. Moreover, by providing the detachable-section through-holes 25*d* at various locations on a plane orthogonal to the thickness direction, the number of detachable-section through-holes 25*d* can be increased by utilizing the area of the plate-like restrained segment 25*b*, thereby increasing the coupling strength by the bolts 23.

Furthermore, with regard to the detachable sections 25 detachably held by the holding sections 22, the gripping segments 25*a* of the detachable sections 25 may have different degrees of elastic bendability against a reaction force received from the processing object P. In this manner, gripping-force characteristics that utilize the elastic force of the coil springs 24 can be changed without having to replace the coil springs 24 serving as spring members.

Figure 8:
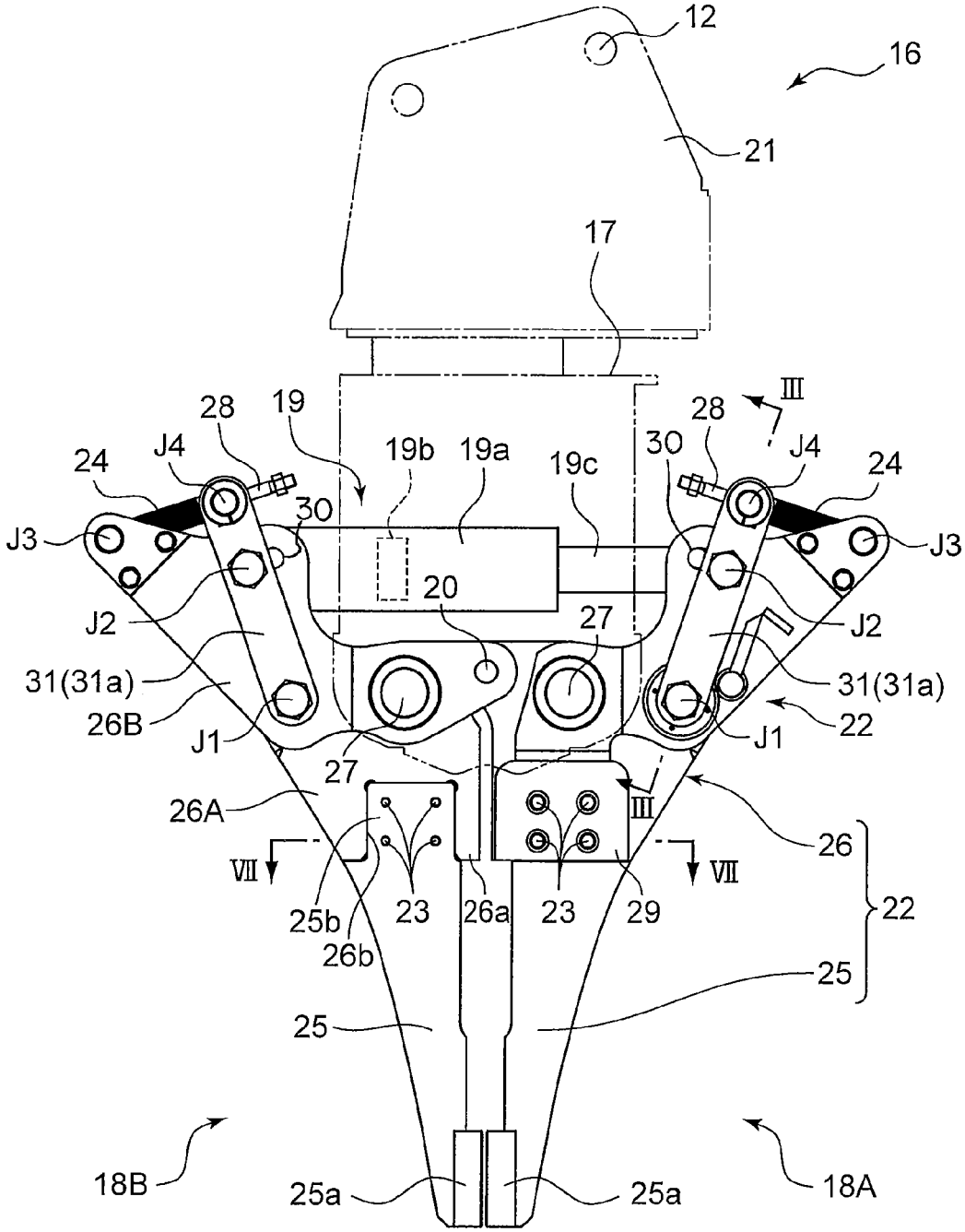
FIG. 8 is a front view showing a gripping device according to a modification of the first embodiment of the present invention.

For example, the detachable sections 25 shown in FIG. 2 may be replaced with detachable sections 25' shown in FIG. 8. In this case, in a state where the detachable sections 25' are held by the holding sections 22, the distance from the central pivot shafts 27 of the holding sections 22 to the gripping segments 25*a* of the detachable sections 25' is longer than that of the detachable sections 25 shown in FIG. 2. This gives the gripping segments 25*a* an increased pivot radius about the central pivot shafts 27, thereby increasing the bendability of the gripping segments 25*a*. In consequence, the gripping-force characteristics can be changed. As another alternative, the gripping-force characteristics can be similarly changed by using materials with different elastic moduli or section moduli for the detachable sections 25.

The gripping-force characteristics can be changed by replacing the detachable sections in this manner regardless of whether the coil springs 24 are present or absent.

The fine adjustment of the gripping force by using the coil springs 24 can be achieved even by omitting the link members 31. In that case, the spring members, such as the coil springs, may be directly connected to the engagement shafts J2 and the holding sections 22.

Figure 9:
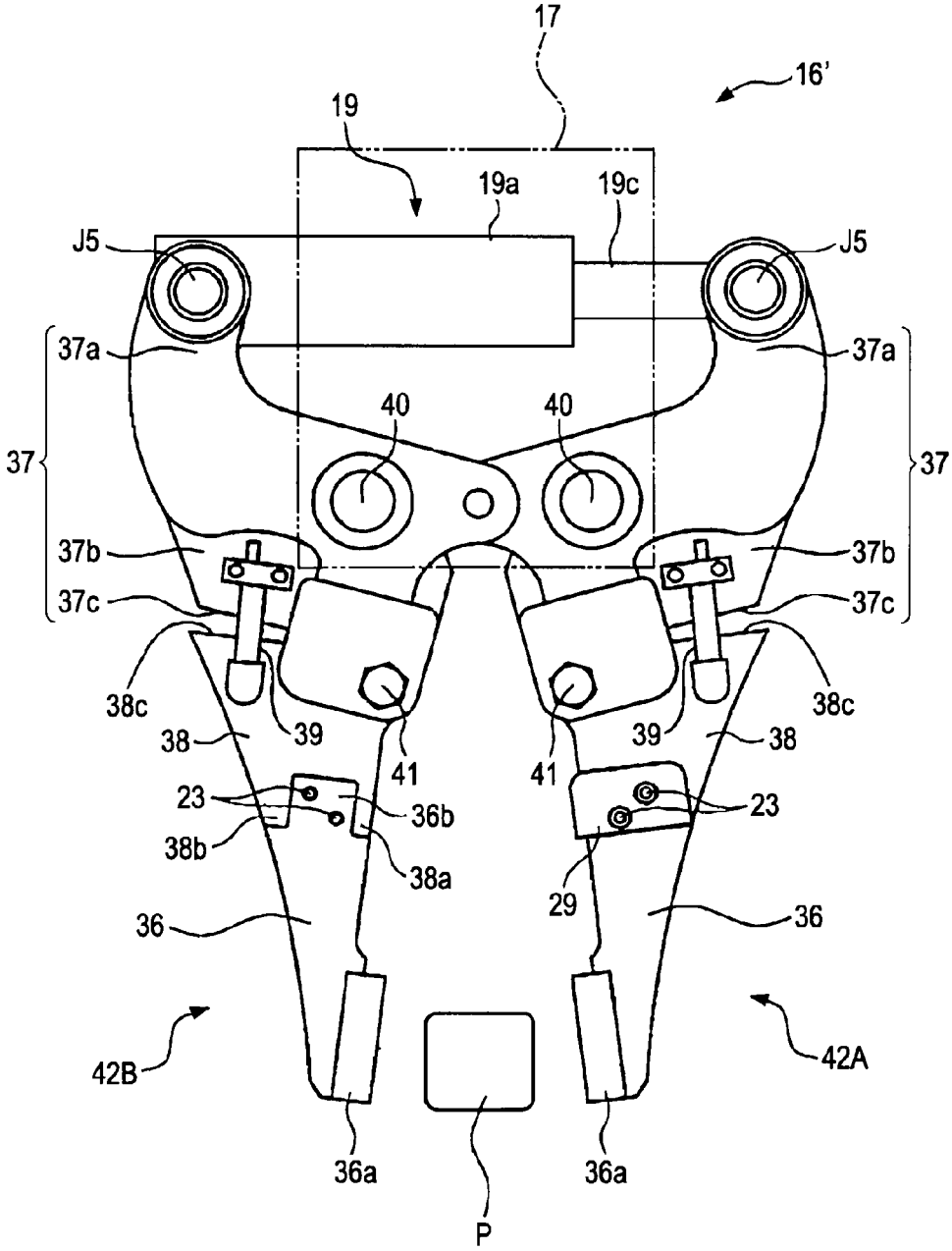
FIG. 9 is a front view showing a gripping device according to a second embodiment of the present invention.
Figure 10B:
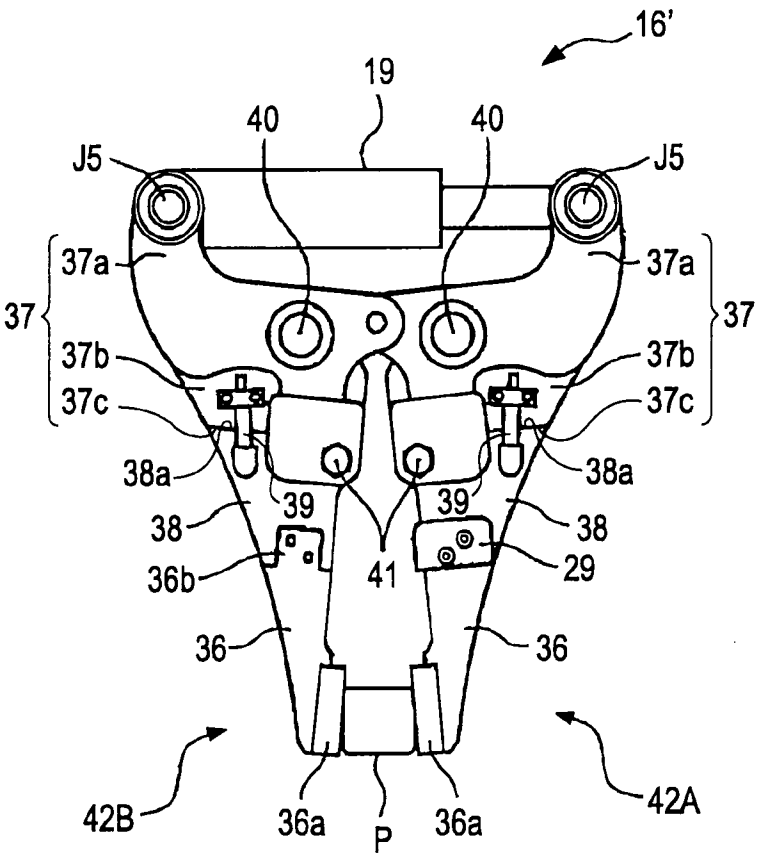
FIGS. 10A and 10B are front views for explaining gripping operation performed by the gripping device in FIG. 9, FIG. 10A showing a state where gripping members and a processing object are in contact with each other and FIG. 10B showing the gripping members in a retreated state.

A further alternative is a gripping device 16' according to a second embodiment of the present invention shown in FIGS. 9 to 10B. The gripping device 16' includes a pair of gripping members 42A and 42B that are pivotable relative to the gripping-device body 17 mounted to the terminal end of the working arm 7, and the grip driving cylinder 19 that causes the gripping members 42A and 42B to pivot relatively. The gripping members 42A and 42B each include a driven portion 37 pivotably mounted to the gripping-device body 17 about a central pivot shaft 40, a holding portion 38 pivotably mounted to the driven portion 37 about a pivot shaft 41 that is parallel to the central pivot shaft 40, and a coil spring 39 serving as a spring member interposed between the driven portion 37 and the holding portion 38. The opposite ends of the grip driving cylinder 19 are respectively connected to the two driven portions 37 in a relatively pivotable manner about shafts J5.

Each of the driven portions 37 has a base-end plate 37*a* pivotably connected to the grip driving cylinder 19 and a terminal-end plate 37*b* provided with the corresponding pivot shaft 41, and is pivotably supported by the gripping-device body 17 via the corresponding central pivot shaft 40 extending through the base-end plate 37*a* and the terminal-end plate 37*b*.

The driven portion 37 and the holding portion 38 of each gripping member are connected to each other via the corresponding pivot shaft 41 so as to be pivotable with respect to each other between a position shown in FIG. 9, that is, a position in which a terminal-end surface 37*c* of the driven portion 37 and a base-end surface 38*c* of the holding portion 38 are spaced apart from each other in the circumferential direction of the pivot shaft 41, and a position shown in FIG. 10B, that is, a position in which the terminal-end surface 37*c* and the base-end surface 38*c* are in close contact with each other.

The coil spring 39 is bridged between the driven portion 37 and the holding portion 38 so as to elastically deform in response to the pivoting movement of the driven portion 37 and the holding portion 38 about the central pivot shaft 40. Specifically, the coil spring 39 biases the holding portion 38 against the driven portion 37 so as to cause the terminal-end surface 37*c* of the driven portion 37 and the base-end surface 38*c* of the holding portion 38 to be spaced apart from each other.

The holding portions 38 have a holding structure that detachably holds detachable sections 36 in a similar manner to the detachable sections 25 in the first embodiment. Specifically, the terminal end of each detachable section 36 is provided with a gripping segment 36*a*, and the base end thereof is provided with a restrained segment 36*b* with a plate-like shape like the restrained segment 25*b* and having a plurality of detachable-section through-holes. On the other hand, each holding portion 38 has an inner restraining segment 38*a* that restrains the corresponding restrained segment 36*b* from the inner side in the opening-closing direction, an outer restraining segment 38*b* that restrains the restrained segment 36*b* from the outer side in the opening-closing direction, and a holding wall including the reinforcement plate 29 shown in FIG. 9. The holding wall is provided with a plurality of holding-section through-holes. The bolts 23 are inserted into the detachable-section through-holes through the holding-section through-holes so as to be fastened in a state where the restrained segment 36*b* overlies the holding wall in a direction parallel to the bolt holes.

Figure 10A:
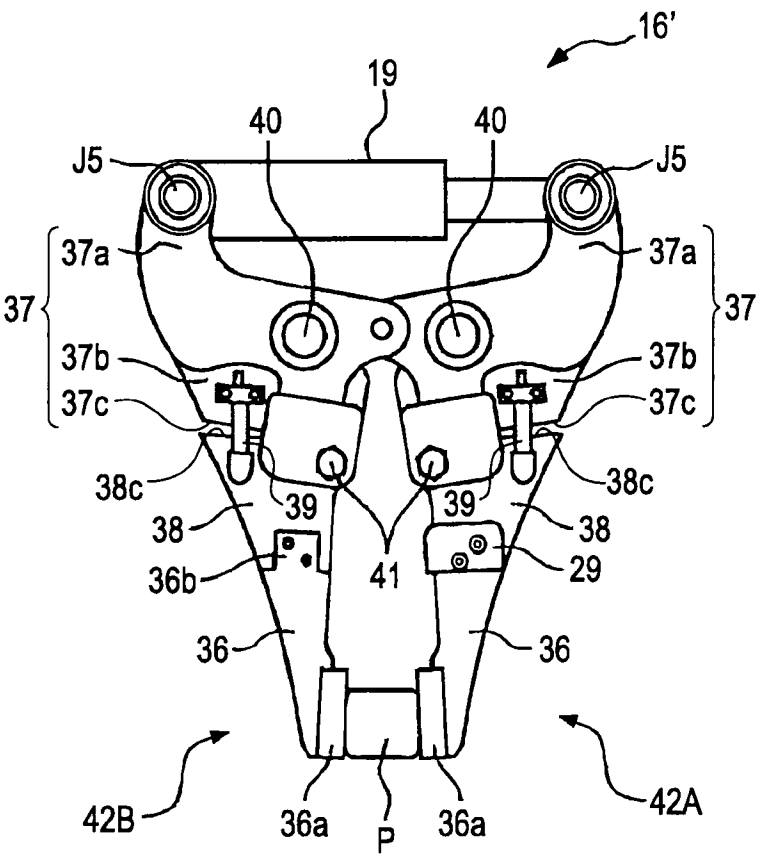
Figure 11:
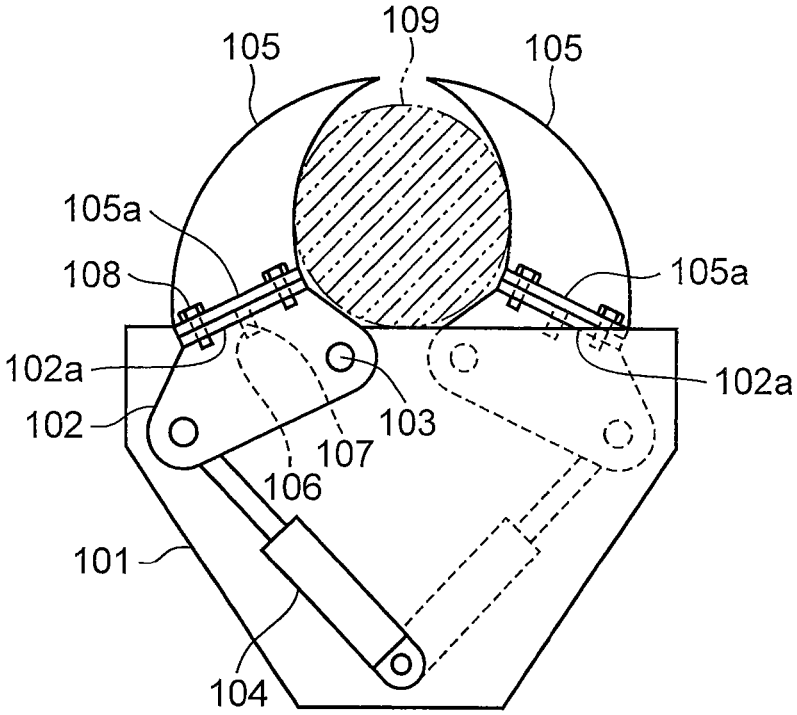
PRIOR ART FIG.11
FIG. 11 is a plan view of a cutting machine, which is a gripping device of the related art.

In the gripping device 16', when the grip driving cylinder 19 is expanded from the state shown in FIG. 9, the gripping members 42A and 42B pivot in the closing direction about the respective central pivot shafts 40 while the positional relationship between the driven portions 37 and the holding portions 38 is maintained by the intervention of the coil springs 39. As this pivoting movement continues and causes the holding portions 38 to come into contact with processing object P, as shown in FIGS. 10A and 10B, the holding portions 38 start to retreat from the driven portions 37 due to a reaction force received from the processing object P as the coil springs 39 are compressed. At this stage, the driving force of the grip driving cylinder 19 is not directly transmitted to the gripping segments 36*a* of the detachable sections 36, but an elastic force equivalent to the amount of compression of the coil springs 39 is transmitted as a gripping force. Therefore, the gripping force can be finely adjusted by utilizing the elastic force of the coil springs 39, as in the first embodiment.

As a relative pivoting amount (retreating amount) of the holding portions 38 with respect to the driven portions 37 increases and the terminal-end surfaces 37*c* of the driven portions 37 and the base-end surfaces 38*c* of the holding portions 38 come into abutment with each other, a further relative pivoting movement is not possible. Thus, the driving force of the grip driving cylinder 19 is directly transmitted to the holding portions 38 from the driven portions 37. Therefore, gripping operation with a large gripping force can be performed from this stage.

In the second embodiment, since the detachable sections 36 are detachably held by the holding portions 38, various kinds of gripping operations can be implemented by replacing the detachable sections 36 while advantageously ensuring fine gripping-force adjustability using the coil springs 39. As a specific holding structure, the holding structure similar to that in the first embodiment can be used so that the bolts 23 used for fastening the holding portions 38 and the detachable sections 36 together can be prevented from receiving a large shearing load, while compactness is still achieved.

Similar to the first embodiment, with regard to the various kinds of detachable sections 36, the gripping segments 36*a* of the detachable sections 36 may have different degrees of elastic bendability against a reaction force received from the processing object P. In this manner, gripping-force characteristics that utilize the elastic force of the coil springs 39 can be changed without having to replace the coil springs 39 serving as spring members.

The present invention is not to be limited to a type that allows for fine gripping-force adjustment by using spring members, as in the above embodiments. For example, the present invention is applicable to a type in which the driven portion 37 and the holding portion 38 of each holding section in the gripping device 16' shown in FIG. 9 are a single unit (i.e., do not pivot relatively to each other).

Although the invention has been described with reference to the preferred embodiments in the attached figures, it is noted that equivalents may be employed and substitutions may be made herein without departing from the scope of the invention as recited in the claims.

What is claimed is:

1. A gripping device provided at a displaceable end of a working arm of a working machine and configured to grip a processing object, the gripping device comprising:

a gripping-device body mounted to the end of the working arm;

a first gripping member and a second gripping member that are pivotably supported by the gripping-device body about respective central pivot shafts parallel to each other and are configured to open and close with respect to each other by pivoting so as to grip and release the processing object; and a driver that causes the first gripping member and the second gripping member to pivot so as to perform opening and closing operations, wherein at least one of the first gripping member and the second gripping member includes:

one of various kinds of detachable sections each including a gripping segment that comes into contact with the processing object so as to grip the processing object;

a holding section pivotably connected to the gripping-device body and selectively holding the detachable section in a detachable manner; and a coupling member for detachably coupling the detachable section to the holding section, wherein an end of the detachable section opposite the gripping segment is provided with a restrained segment, the restrained segment being provided with a detachable-section through-hole extending therethrough in a direction parallel to the central pivot shafts and through which the coupling member is insertable, wherein the holding section has an opening-closing-direction restraining segment that restrains the restrained segment from at least an outer side in an opening-closing direction and a holding wall capable of overlying the restrained segment, located at a position restrained by the opening-closing-direction restraining segment, from a direction parallel to the detachable-section through-hole, wherein the holding wall is provided with a holding-section through-hole aligned with the detachable-section through-hole and through which the coupling member is insertable, and wherein the coupling member couples the restrained segment to the holding wall in a state where the coupling member is inserted through both the detachable-section through-hole and the holding-section through-hole, wherein said at least one of the first gripping member and the second gripping member comprises both of the first gripping member and the second gripping member, wherein the driver includes a grip driving cylinder that is connected to the holding section of the first gripping member and the holding section of the second gripping member and that is configured to expand and contract so as to open and close the gripping members, and wherein said at least one of the first gripping member and the second gripping member further includes an engagement member that is connected to the grip driving cylinder so as to operate in conjunction with expansion and contraction of the grip driving cylinder and that is engaged with a slot formed in the corresponding holding section so as to be relatively displaceable only within a predetermined range of the slot with respect to the holding section, and a spring member provided between the holding section and the engagement member, wherein when the grip driving cylinder performs driving operation, the spring member transmits a driving force of the grip driving cylinder to the gripping-device body while maintaining a predetermined positional relationship between the engagement member and the holding section, elastically deforms due to a reaction force received from the processing object by the corresponding detachable section and the holding section holding the detachable section so as to permit displacement of the holding section relative to the engagement member, and transmits an elastic force to the corresponding gripping segment as a gripping force.

2. The gripping device of a working machine according to claim 1, wherein in the various kinds of detachable sections, the gripping segments of the detachable sections include gripping segments with different degrees of elastic bendability against a reaction force received from the processing object.

3. The gripping device of a working machine according to claim 2, wherein the various kinds of detachable sections include detachable sections with different distances from the central pivot shafts of the holding section to the gripping segments of the detachable sections in a state where the gripping segments are held by the holding section.

4. A working machine comprising:

a movable working-machine body; a working arm mounted on the working-machine body and operable such that an end thereof is displaceable relative to the working machine; and the gripping device according to claim 1 that is mounted to the end of the working arm.

5. A gripping device provided at a displaceable end of a working arm of a working machine and configured to grip a processing object, the gripping device comprising:

a gripping-device body mounted to the end of the working arm;

a first gripping member and a second gripping member that are pivotably supported by the gripping-device body about respective central pivot shafts parallel to each other and are configured to open and close with respect to each other by pivoting so as to grip and release the processing object; and a driver that causes the first gripping member and the second gripping member to pivot so as to perform opening and closing operations, wherein at least one of the first gripping member and the second gripping member includes:

one of various kinds of detachable sections each including a gripping segment that comes into contact with the processing object so as to grip the processing object;

a holding section pivotably connected to the gripping-device body and selectively holding the detachable section in a detachable manner; and a coupling member for detachably coupling the detachable section to the holding section, wherein an end of the detachable section opposite the gripping segment is provided with a restrained segment, the restrained segment being provided with a detachable-section through-hole extending therethrough in a direction parallel to the central pivot shafts and through which the coupling member is insertable, wherein the holding section has an opening-closing-direction restraining segment that restrains the restrained segment from at least an outer side in an opening-closing direction and a holding wall capable of overlying the restrained segment, located at a position restrained by the opening-closing-direction restraining segment, from a direction parallel to the detachable-section through-hole, wherein the holding wall is provided with a holding-section through-hole aligned with the detachable-section through-hole and through which the coupling member is insertable, and wherein the coupling member couples the restrained segment to the holding wall in a state where the coupling member is inserted through both the detachable-section through-hole and the holding-section through-hole, wherein said at least one of the first gripping member and the second gripping member comprises both of the first gripping member and the second gripping member, wherein the holding sections of the two gripping members are connected to the gripping-device body so as to be pivotable about the respective central pivot shafts, and each have a driven portion driven by the driver and a holding portion connected to the driven portion in a relatively pivotable manner only within a predetermined range about an axis parallel to the central pivot shafts and including the opening-closing-direction restraining segment and the holding wall, wherein each of the two gripping members further includes a spring member provided between the corresponding holding portion and the driven portion, wherein the spring member transmits a driving force of the driver from the driven portion to the holding portion while maintaining a predetermined positional relationship between the driven portion and the holding portion, elastically deforms due to a reaction force received from the processing object by the holding portion and the detachable section held by the holding portion so as to permit displacement of the holding portion relative to the driven portion, and transmits an elastic force to the gripping segment as a gripping force.

6. The gripping device of a working machine according to claim 5, wherein in the various kinds of detachable sections, the gripping segments of the detachable sections include gripping segments with different degrees of elastic bendability against a reaction force received from the processing object.

7. The gripping device of a working machine according to claim 6, wherein the various kinds of detachable sections include detachable sections with different distances from the central pivot shafts of the holding section to the gripping segments of the detachable sections in a state where the gripping segments are held by the holding section.

8. A working machine comprising:

a movable working-machine body;

a working arm mounted on the working-machine body and operable such that an end thereof is displaceable relative to the working machine; and the gripping device according to claim 5 that is mounted to the end of the working arm.

* * * * *